US011210923B2

(12) United States Patent
Chen et al.

(10) Patent No.: US 11,210,923 B2
(45) Date of Patent: Dec. 28, 2021

(54) CARBON MONOXIDE MONITORING SYSTEM SUITABLE FOR UNCONDITIONED SPACES

(71) Applicant: CARRIER CORPORATION, Palm Beach Gardens, FL (US)

(72) Inventors: Lei Chen, South Windsor, CT (US); Travis Silver, Colorado Springs, CO (US); Zhiwei Yang, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 0 days.

(21) Appl. No.: 16/973,577

(22) PCT Filed: Sep. 9, 2019

(86) PCT No.: PCT/US2019/050154

§ 371 (c)(1),
(2) Date: Dec. 9, 2020

(87) PCT Pub. No.: WO2020/055721

PCT Pub. Date: Mar. 19, 2020

(65) Prior Publication Data

US 2021/0248896 A1 Aug. 12, 2021

Related U.S. Application Data

(60) Provisional application No. 62/731,163, filed on Sep. 14, 2018.

(51) Int. Cl.

| | |
|---|---|
| ***G08B 21/00*** | (2006.01) |
| ***G08B 21/14*** | (2006.01) |
| ***G08B 21/18*** | (2006.01) |

(52) U.S. Cl.
CPC ..... *G08B 21/14* (2013.01); *G08B 21/182* (2013.01)

(58) Field of Classification Search
CPC ..... G08B 21/14; G08B 21/182
See application file for complete search history.

(56) References Cited

U.S. PATENT DOCUMENTS

| | | |
|---|---|---|
| 5,517,182 A | 5/1996 | Yasunaga |
| 6,208,256 B1 | 3/2001 | Fleming et al. |

(Continued)

FOREIGN PATENT DOCUMENTS

| | | |
|---|---|---|
| CN | 107389131 A | 11/2017 |
| EP | 0764847 A1 | 3/1997 |
| GB | 2373048 A | 9/2002 |

OTHER PUBLICATIONS

International Search Report and Written Opinion for International application No. PCT/US2019/050154 dated Nov. 12, 2019.

(Continued)

*Primary Examiner* — Ojiako K Nwugo
(74) *Attorney, Agent, or Firm* — Carlson, Gaskey & Olds

(57) ABSTRACT

An illustrative example monitoring system includes a carbon monoxide sensor configured to detect carbon monoxide within an area, a heater situated near the carbon monoxide sensor to regulate a temperature of the carbon monoxide sensor, an ambient temperature sensor configured to provide an indication of an ambient temperature in the area, an occupancy sensor configured to provide an indication whether the area is occupied by at least one individual and a controller. The controller is configured to determine whether the ambient temperature in the area is below a threshold based on the indication from the ambient temperature sensor, determine whether the area is occupied by at least one individual based on the indication from the occupancy sensor, and activate the heater when the ambient (Continued)

temperature in the area is below the threshold and the area is occupied by at least one individual.

20 Claims, 2 Drawing Sheets

(56) References Cited

U.S. PATENT DOCUMENTS

| | | | | |
|---|---|---|---|---|
| 6,426,703 | B1 | 7/2002 | Johnston et al. | |
| 6,647,783 | B2 | 11/2003 | Wewers et al. | |
| 6,985,082 | B1 | 1/2006 | Dutta et al. | |
| 7,183,933 | B2 | 2/2007 | Dzurko et al. | |
| 9,134,180 | B2 | 9/2015 | James et al. | |
| 9,194,358 | B1 | 11/2015 | Avramidis | |
| 9,196,146 | B1 | 11/2015 | Vicente | |
| 2003/0020619 | A1 | 1/2003 | Winters et al. | |
| 2003/0098784 | A1* | 5/2003 | Van Bosch | G08B 21/24 340/425.5 |
| 2004/0084308 | A1 | 5/2004 | Cole et al. | |
| 2005/0212681 | A1* | 9/2005 | Dzurko | G08B 21/14 340/632 |
| 2006/0032290 | A1* | 2/2006 | Liu | G01N 29/326 73/29.02 |
| 2007/0120693 | A1* | 5/2007 | Vij | G08B 21/14 340/632 |
| 2008/0173817 | A1* | 7/2008 | Goldstein | G01N 21/783 250/338.1 |
| 2010/0201530 | A1 | 8/2010 | Wende | |
| 2017/0176539 | A1* | 6/2017 | Younger | G01R 31/367 |

OTHER PUBLICATIONS

International Preliminary Report on Patentability for International Application No. PCT/US2019/050154, dated Mar. 25, 2021.

* cited by examiner

CARBON MONOXIDE MONITORING SYSTEM SUITABLE FOR UNCONDITIONED SPACES

CROSS-REFERENCE TO RELATED APPLICATIONS

This is a national stage application of International Application No. PCT/US2019/050154, filed on Sep. 9, 2019, which claims priority to U.S. Provisional Application No. 62/731,163, which was filed on Sep. 14, 2018, and is incorporated herein by reference.

BACKGROUND

Various air quality monitoring devices are known. Carbon monoxide (CO) sensors are often used to monitor the air in an enclosed space or building to provide a warning or alarm when a threshold amount of carbon monoxide is present.

Most carbon monoxide sensors used in residential CO alarms do not require temperature regulation due to the typically relatively mild temperature in a household environment. Even in those instances, the CO sensor output moderately depends on ambient temperature and humidity. The sensitivity of CO sensors tends to decrease with temperature, particularly when the ambient temperature decreases to deep freezing conditions, such as below −20° C. Extreme temperatures are not uncommon in unconditioned spaces such as recreational vehicles and boats. One solution to maintain CO sensor performance in extremely low temperatures is to thermally condition the sensor. However, when such sensors operate based on battery or other back up power the heater tends to use significant amounts of the available capacity, which limits the availability or usefulness of the sensor over time. Besides sluggish or inaccurate response from CO sensors under such extreme conditions, notifications from alarms tripped in unoccupied spaces due to external CO sources also can cause unnecessary power consumption.

SUMMARY

An illustrative example monitoring system includes a carbon monoxide sensor configured to detect carbon monoxide within an area, a heater situated near the carbon monoxide sensor to regulate a temperature of the carbon monoxide sensor, an ambient temperature sensor configured to provide an indication of an ambient temperature in the area, an occupancy sensor configured to provide an indication whether the area is occupied by at least one individual and a controller. The controller is configured to determine whether the ambient temperature in the area is below a threshold based on the indication from the ambient temperature sensor, determine whether the area is occupied by at least one individual based on the indication from the occupancy sensor, and activate the heater when the ambient temperature in the area is below the threshold and the area is occupied by at least one individual.

In an example embodiment having one or more features of the monitoring system of the previous paragraph, the carbon monoxide sensor has a detection and notification mode and a power saving mode, the controller causes the carbon monoxide sensor to be in the detection and notification mode when the heater is activated, and the controller causes the carbon monoxide sensor to be in the power saving mode when the ambient temperature in the area is below the threshold and the area is unoccupied.

In an example embodiment having one or more features of the monitoring system of any of the previous paragraphs, the power saving mode includes the carbon monoxide sensor being capable of at least carbon monoxide detection.

In an example embodiment having one or more features of the monitoring system of any of the previous paragraphs, the controller causes the occupancy sensor to be in a power saving mode and periodically wake up for occupancy detection at a pre-determined interval that ranges from 30 seconds to 3 minutes.

In an example embodiment having one or more features of the monitoring system of any of the previous paragraphs, the controller causes the carbon monoxide sensor to be in the detection and notification mode when the ambient temperature in the area is above the threshold.

In an example embodiment having one or more features of the monitoring system of any of the previous paragraphs, the controller causes the heater to be off when the ambient temperature in the area is above the threshold.

In an example embodiment having one or more features of the monitoring system of any of the previous paragraphs, the area is inside a boat or a recreational vehicle.

In an example embodiment having one or more features of the monitoring system of any of the previous paragraphs, the threshold is less than or equal to −10° C.

In an example embodiment having one or more features of the monitoring system of any of the previous paragraphs, the threshold is −20° C.

An example embodiment having one or more features of the monitoring system of any of the previous paragraphs includes a battery that provides power to at least the heater and the controller.

In an example embodiment having one or more features of the monitoring system of any of the previous paragraphs, the battery is a backup power source; the system comprises a primary power source that provides power to the carbon monoxide sensor, the heater and the controller; and the controller causes the carbon monoxide sensor to be in a detection and notification mode whenever the primary source is available.

In an example embodiment having one or more features of the monitoring system of any of the previous paragraphs, the heater comprises a flexible heater tape encapsulated in a polyimide-based film.

An illustrative example method of monitoring carbon monoxide in an area includes determining whether an ambient temperature in the area is below a threshold, determining whether the area is occupied by at least one individual, and activating a heater to regulate a temperature of a carbon monoxide sensor in the area when the ambient temperature in the area is below the threshold and the area is occupied by at least one individual.

In an example embodiment having one or more features of the method of the previous paragraph, the carbon monoxide sensor has a detection and notification mode and a power saving mode; the carbon monoxide sensor is in the detection and notification mode when the heater is activated; and the carbon monoxide sensor is in the power saving mode when the ambient temperature in the area is below the threshold and the area is unoccupied.

In an example embodiment having one or more features of the method of any of the previous paragraphs, the carbon monoxide sensor is in the detection and notification mode when the ambient temperature in the area is above the threshold.

An example embodiment having one or more features of the method of any of the previous paragraphs includes keeping the heater off when the ambient temperature in the area is above the threshold.

In an example embodiment having one or more features of the method of any of the previous paragraphs, the power saving mode includes the carbon monoxide sensor being capable of at least carbon monoxide detection.

In an example embodiment having one or more features of the method of any of the previous paragraphs, the area is inside a boat or a recreational vehicle.

In an example embodiment having one or more features of the method of any of the previous paragraphs, the threshold is less than or equal to −10° C.

In an example embodiment having one or more features of the method of any of the previous paragraphs, the threshold is −20° C.

The various features and advantages of at least one disclosed example embodiment will become apparent to those skilled in the art from the following detailed description. The drawings that accompany the detailed description can be briefly described as follows.

DETAILED DESCRIPTION

Figure 1:
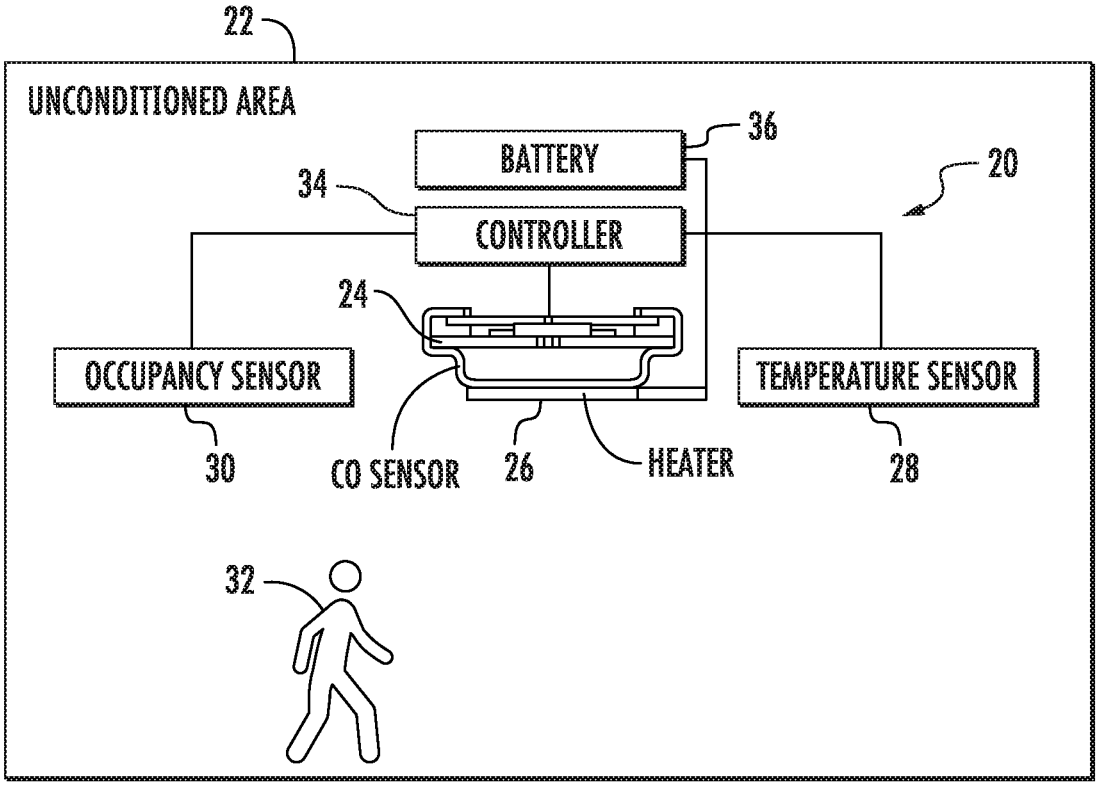
FIG. 1 schematically illustrates a monitoring system designed according to an embodiment of this invention.

FIG. 1 schematically illustrates a carbon monoxide monitoring system 20 that monitors carbon monoxide (CO) levels in an area 22. The illustrated example system 20 is capable of monitoring carbon monoxide levels in unconditioned areas that are not heated and subject to cold ambient temperatures within the area 22. Examples of such unconditioned areas include the inside of a boat or recreational vehicle.

The system 20 includes a carbon monoxide sensor 24 that is configured to detect carbon monoxide levels within the area 22. The carbon monoxide sensor 24 may require heating when the ambient temperature in the area 22 is below a threshold. For example, the carbon monoxide sensor 24 may have a delayed or inhibited response when the ambient temperature in the area 22 is −10° C. or less, such as about −10° C. to about −20° C. A heater 26 selectively heats the carbon monoxide sensor 24 under such conditions to regulate the temperature of the CO sensor 24. The heater 26 is situated near the CO sensor 24, which may include the heater 26 being at least partially on a portion of the CO sensor 24.

In an example embodiment, the heater 26 comprises a flexible heating element encapsulated in a polyimide-based film. The heater 26 in the illustrated example embodiment is secured to a thermally conductive exterior of the CO sensor 24 for heating the CO sensor 24 on demand. Alternatively, the heater can be placed on top of the CO sensor 24 with openings to allow for air transport to the sensing element encapsulated in the sensor housing. The example CO sensor 24 has a low thermal mass that allows the heater 26 to raise the temperature of the CO sensor 24 to a desired temperature more efficiently.

A temperature sensor 28 provides an indication of the ambient temperature within the area 22. An occupancy sensor 30 provides an indication of whether the area 22 is occupied by at least one individual 32. The occupancy sensor 30 in some example embodiments comprises a motion sensor that operates in a known manner to detect motion of an individual 32 within the area 22. Other types of occupancy sensors are included in other example embodiments. The occupancy sensor 30 may include passive infrared (PIR) sensors, vibration sensors, imaging (e.g., through a camera), or atmosphere composition detection as a basis for detecting the presence of at least one individual 32 within the area 22.

A controller 34 is programmed or configured to determine when the heater 26 is needed for desired operation of the carbon monoxide sensor 24. The controller 34 determines an ambient temperature within the area 22 based on an indication from the temperature sensor 28. The controller 34 determines whether the area 22 is occupied by at least one individual 32 based on an indication from the occupancy sensor 30. The controller 34 uses the information regarding the temperature and occupancy status of the area 22 to control when the heater 26 operates to warm the carbon monoxide sensor 24. The controller 34 selectively controls the heater 26 to save on the charge or energy available from a battery 36 that provides power to the heater 26. The battery 36 may also provide power to the controller 34, the carbon monoxide sensor 24, the occupancy sensor 30, and the temperature sensor 28 to the extent any of those components require electrical power for proper operation.

Some embodiments have a primary power source (not illustrated) and the battery 36 operates as a back up power source in such embodiments. In other embodiments, the battery 36 is the primary power source for the system 20.

Figure 2:
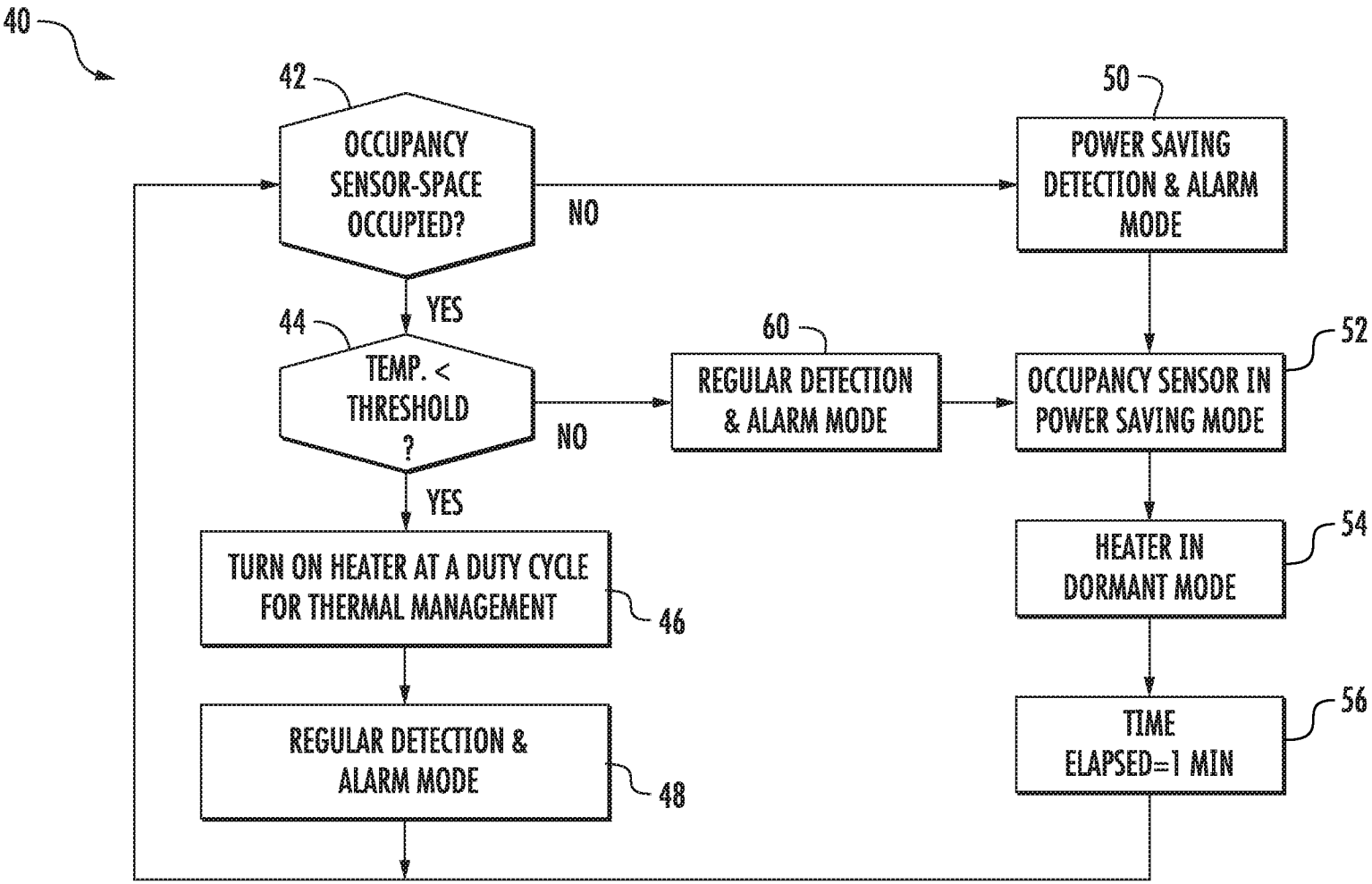
FIG. 2 is a flowchart diagram summarizing an example monitoring method designed according to an embodiment of this invention.

FIG. 2 summarizes, in a flowchart diagram 40, an example technique for monitoring carbon monoxide within the area 22. At 42, the controller 34 periodically determines the occupancy status of the area 22 based on the indication from the occupancy sensor 30. If the area is occupied by at least one person, the controller will determine the ambient temperature at 44 based on an indication from the temperature sensor 28. If the ambient temperature is below a predetermined threshold, such as −20° C. in an example, at 46 the controller 34 turns on the heater 26 at a duty cycle to maintain the temperature near or on the CO sensor 24 amenable for sufficient sensitivity and causes the carbon monoxide sensor 24 to operate in a regular detection and alarm mode at 48. The temperature threshold is selected to avoid a lack of CO sensitivity and in some embodiments is at or below −10° C. A threshold of −20° C. is useful with a variety of carbon monoxide sensor configurations.

The controller 34 periodically checks if the area 22 is still occupied 42 and continues to operate the heater at 46 and the CO detector at 48 while the area is occupied and the temperature in the area 22 remains below the threshold. Although not shown in FIG. 2, in order to conserve power in some embodiments there may be a delay between periods where the controller 34 periodically checks if the area 22 is still occupied. Such delays may be variable, for example, the duration between periods may decrease if occupancy sensor readings tend to indicate that the space 22 has less activity. For example, if vibration sensors or atmosphere composition detection show a decrease in the likelihood of human presence, the period between checks may decrease.

If the controller 34 determines at 42 that the area 22 is not occupied, the controller 34 causes the carbon monoxide sensor 24 to be in a power saving detection and alarm mode at 50 where low power notification mechanisms are utilized. The occupancy sensor is placed into a power saving mode at 52 and the heater 26 is set in a dormant mode at 54. After a predetermined period of time has elapsed at 56, the controller 34 again determines at 42 whether the area 22 is occupied. The time period at 56 may be on the order of one minute, for example. In some embodiments, the power saving mode of the occupancy sensor 30 administers the periodic wake-up operation at 56 using the predetermined interval. This interval is set to ensure there is enough time for the CO sensor 24 to detect CO after the occupancy sensor 30 is activated. The time interval for the occupancy sensor 30 to wake up is generally shorter than the time required to trip CO alarms. This interval can vary from 30 seconds to 3 minutes. In some embodiments the interval is around 1-2 minutes.

If the controller 34 determines at 44 that the temperature within the area 22 exceeds the threshold, the controller 34 places the CO sensor 24 into a regular detection and alarm mode at 60, the occupancy sensor 30 into the power saving mode at 52 and the heater 26 into the dormant mode at 54. In the example of FIG. 2, the carbon monoxide sensor 24 operates in the regular detection and alarm mode at 60 whenever the temperature exceeds the threshold temperature. Under such conditions, the controller 34 responds to a wake-up signal or communication from the occupancy sensor 30 periodically and determines whether the space 22 is still unoccupied at 42. In the example of FIG. 2, the controller 34 rechecks the occupancy status at an interval of about 1 minute as indicated at 56.

Controlling operation of the heater 26 and carbon monoxide sensor 24 based on the temperature within the area 22 and whether the area 22 is occupied or unoccupied provides the ability to have accurate and responsive carbon monoxide detection within an unconditioned area while saving on consumption of the charge or energy available from the battery 36. Selectively using the heater 26 to regulate the temperature of the carbon monoxide sensor 24 ensures an appropriately fast response time from the carbon monoxide sensor 24 that complies with regulatory standards and makes the sensor 24 available when needed.

In one example embodiment, the carbon monoxide sensor 24 enters a power saving alarm mode whenever the area 22 is unoccupied. This operating mode will keep the CO sensor 24 always in a detection mode but reduce the power consumption otherwise associated with providing an alarm and notification in the event that CO external to the unoccupied space 22 is detected. The occupancy sensor 30 periodically provides a wake up signal whenever an individual 32 is detected within the area 22. The time interval for the occupancy sensor 30 to wake up is generally shorter than the time required to trip CO alarms. This interval can vary from 30 seconds to 3 minutes and will be around 1-2 minutes in some embodiments.

With example embodiments of this invention, carbon monoxide detection is available in unconditioned spaces even under extremely low temperature conditions. This is true even in areas where electrical power is not available from a grid, for example, and may be used in remote areas. Embodiments of this invention allow for using commercially available carbon monoxide sensors in environments and under conditions where such sensors have previously not been able to provide satisfactory carbon monoxide monitoring performance.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A monitoring system, comprising:
a carbon monoxide sensor configured to detect carbon monoxide within an area;
a heater situated near the carbon monoxide sensor to regulate a temperature of the carbon monoxide sensor;
an ambient temperature sensor configured to provide an indication of an ambient temperature in the area;
an occupancy sensor configured to provide an indication whether the area is occupied by at least one individual; and
a controller that is configured to:
determine whether the ambient temperature in the area is below a threshold based on the indication from the ambient temperature sensor,
determine whether the area is occupied by at least one individual based on the indication from the occupancy sensor, and
activate the heater when the ambient temperature in the area is below the threshold and the area is occupied by at least one individual.

2. The monitoring system of claim 1, wherein
the carbon monoxide sensor has a detection and notification mode and a power saving mode;
the controller causes the carbon monoxide sensor to be in the detection and notification mode when the heater is activated; and
the controller causes the carbon monoxide sensor to be in the power saving mode when the ambient temperature in the area is below the threshold and the area is unoccupied.

3. The monitoring system of claim 2, wherein the power saving mode includes the carbon monoxide sensor being capable of at least carbon monoxide detection.

4. The monitoring system of claim 2, wherein the controller causes the occupancy sensor to be in a power saving mode and periodically wake up for occupancy detection at a predetermined interval that ranges from 30 seconds to 3 minutes.

5. The monitoring system of claim 2, wherein the controller causes the carbon monoxide sensor to be in the detection and notification mode when the ambient temperature in the area is above the threshold.

6. The monitoring system of claim 5, wherein the controller causes the heater to be off when the ambient temperature in the area is above the threshold.

7. The monitoring system of claim 1, wherein the area is inside a boat or a recreational vehicle.

8. The monitoring system of claim 1, wherein the threshold is less than or equal to −10° C.

9. The monitoring system of claim 8, wherein the threshold is −20° C.

10. The monitoring system of claim 1, comprising a battery that provides power to at least the heater and the controller.

11. The monitoring system of claim 10, wherein
the battery is a backup power source;
the system comprises a primary power source that provides power to the carbon monoxide sensor, the heater and the controller; and
the controller causes the carbon monoxide sensor to be in a detection and notification mode whenever the primary source is available.

12. The monitoring system of claim 1, wherein the heater comprises a flexible heater tape encapsulated in a polyimide-based film.

13. A method of monitoring carbon monoxide in an area, the method comprising:

determining whether an ambient temperature in the area is below a threshold;

determining whether the area is occupied by at least one individual; and activating a heater to regulate a temperature of a carbon monoxide sensor in the area when the ambient temperature in the area is below the threshold and the area is occupied by at least one individual.

14. The method of claim 13, wherein the carbon monoxide sensor has a detection and notification mode and a power saving mode;

the carbon monoxide sensor is in the detection and notification mode when the heater is activated; and the carbon monoxide sensor is in the power saving mode when the ambient temperature in the area is below the threshold and the area is unoccupied.

15. The method of claim 14, wherein the carbon monoxide sensor is in the detection and notification mode when the ambient temperature in the area is above the threshold.

16. The method of claim 15, comprising keeping the heater off when the ambient temperature in the area is above the threshold.

17. The method of claim 14, wherein the power saving mode includes the carbon monoxide sensor being capable of at least carbon monoxide detection.

18. The method of claim 13, wherein the area is inside a boat or a recreational vehicle.

19. The method of claim 13, wherein the threshold is less than or equal to −10° C.

20. The method of claim 19, wherein the threshold is −20° C.

* * * * *